US009003577B2

(12) United States Patent
Kopp et al.

(10) Patent No.: US 9,003,577 B2
(45) Date of Patent: Apr. 14, 2015

(54) LIGATURE-RESISTANT LAVATORY ASSEMBLY AND ADJUSTABLE FAUCET AND VALVE

(76) Inventors: Laurence D. Kopp, Greenlawn, NY (US); Edward J. Kopp, Wharton, NJ (US); Christopher L. Kopp, South Setauket, NY (US)

( * ) Notice: Subject to any disclaimer, the term of this patent is extended or adjusted under 35 U.S.C. 154(b) by 221 days.

(21) Appl. No.: 13/408,207

(22) Filed: Feb. 29, 2012

(65) Prior Publication Data

US 2013/0220460 A1 Aug. 29, 2013

(51) Int. Cl.

| | |
|---|---|
| ***A47K 1/04*** | (2006.01) |
| ***E03C 1/04*** | (2006.01) |
| ***F16K 31/60*** | (2006.01) |
| ***E03C 1/05*** | (2006.01) |
| ***E03C 1/122*** | (2006.01) |

(52) U.S. Cl.

CPC ..... *E03C 1/0412* (2013.01); *E03C 1/052* (2013.01); *E03C 1/1225* (2013.01); *Y10S 4/15* (2013.01)

(58) Field of Classification Search

USPC ..... 4/DIG. 15, 675, 677, 650, 630, 631, 4/619; D23/308; 312/228

See application file for complete search history.

(56) References Cited

U.S. PATENT DOCUMENTS

| | | | | |
|---|---|---|---|---|
| 1,125,564 | A | 1/1915 | Krohn | |
| 1,949,181 | A | 2/1934 | Champlain | |
| 2,139,671 | A | 12/1938 | Corbin, Jr. | |
| 2,185,186 | A * | 1/1940 | Coordes | 4/619 |
| 2,501,008 | A | 3/1950 | Schramm | |
| 2,643,669 | A | 6/1953 | Logan | |
| 2,767,407 | A | 10/1956 | Weiss | |
| 2,959,186 | A | 11/1960 | McClenahan | |
| 3,451,068 | A | 6/1969 | Phillips, Jr. | |
| D219,341 | S * | 12/1970 | Jacoby | D23/274 |
| 3,577,572 | A | 5/1971 | Ruggles | |
| 4,030,145 | A * | 6/1977 | Rowan | 4/664 |
| 4,453,202 | A | 6/1984 | Morris et al. | |
| 4,537,350 | A | 8/1985 | Apri | |
| 4,620,328 | A | 11/1986 | Lissau | |
| 4,648,426 | A | 3/1987 | Oberholtzer | |
| D312,123 | S | 11/1990 | Enthoven | |
| 5,363,720 | A | 11/1994 | Sanchez | |
| 5,694,653 | A | 12/1997 | Harald | |
| 5,819,335 | A | 10/1998 | Hennessy | |
| 6,330,774 | B1 * | 12/2001 | Weinstein | 52/314 |
| 6,805,330 | B2 | 10/2004 | Bush | |
| 6,843,468 | B2 | 1/2005 | Marshall et al. | |
| 7,007,318 | B1 * | 3/2006 | Bork et al. | 4/664 |

(Continued)

OTHER PUBLICATIONS

Suicide resistant sink/vanity|combo unit|Norva Plastics dated Feb. 23, 2010 the Google search snapshot that shows the date for the above suicide resistant sink/vanity link.*

*Primary Examiner* — Huyen Le
*Assistant Examiner* — Christine Skubinna
(74) *Attorney, Agent, or Firm* — Galgano & Associates, PLLC; Thomas M. Galgano; Jessica G. Bower

(57) ABSTRACT

Ligature-resistant lavatory assembly incorporating a ligature-resistant adjustable faucet and valve, particularly suitable for use in behavioral health, psychiatric facilities, or prisons. The ligature-resistant adjustable faucet control includes a fixable seating element and a control knob at least partially rotatable received in the seating element. The control knob is connected to a mixing valve so that rotation of said control knob controls the mixing valve and, in turn, adjusts the temperature of water dispensed from the faucet.

12 Claims, 6 Drawing Sheets

(56) References Cited

U.S. PATENT DOCUMENTS

| | | | | |
|---|---|---|---|---|
| 7,096,522 | B2 | 8/2006 | Hirtriter | |
| 7,398,788 | B2 * | 7/2008 | DeHart | 134/115 R |
| 7,631,655 | B1 * | 12/2009 | Kopp | 137/15.18 |
| 2008/0078019 | A1 | 4/2008 | Allen, Jr. | |
| 2010/0175183 | A1 * | 7/2010 | Cannon et al. | 4/679 |
| 2011/0120024 | A1 * | 5/2011 | Shilts | 49/506 |

* cited by examiner

Fig. 6
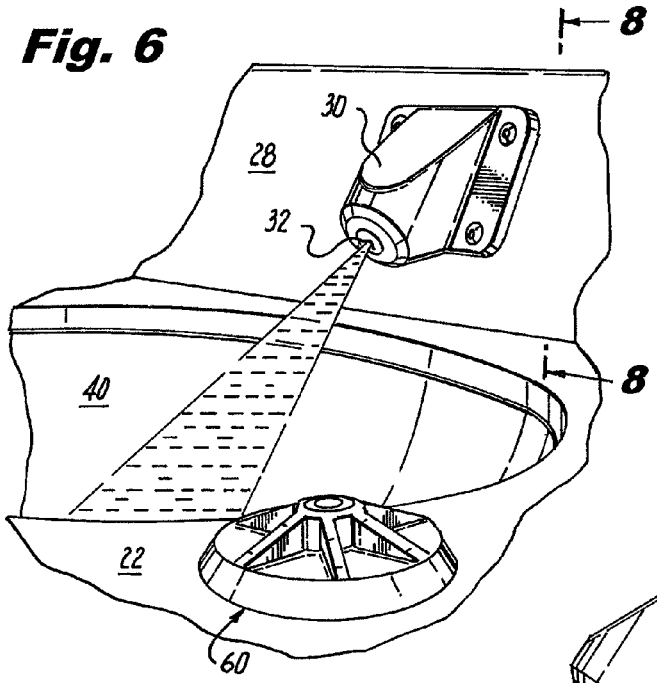
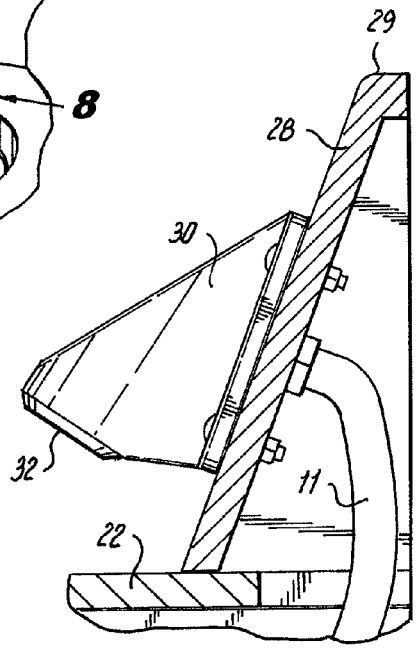
Fig. 8
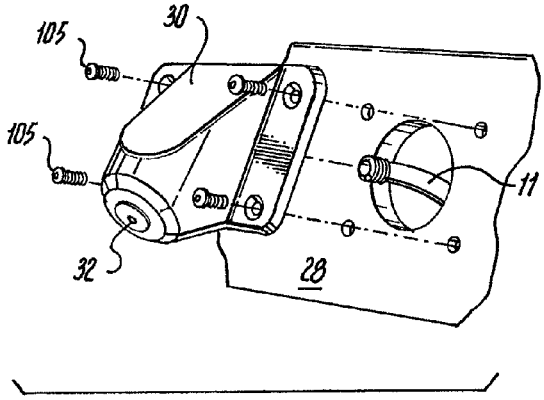
Fig. 7

Fig. 9
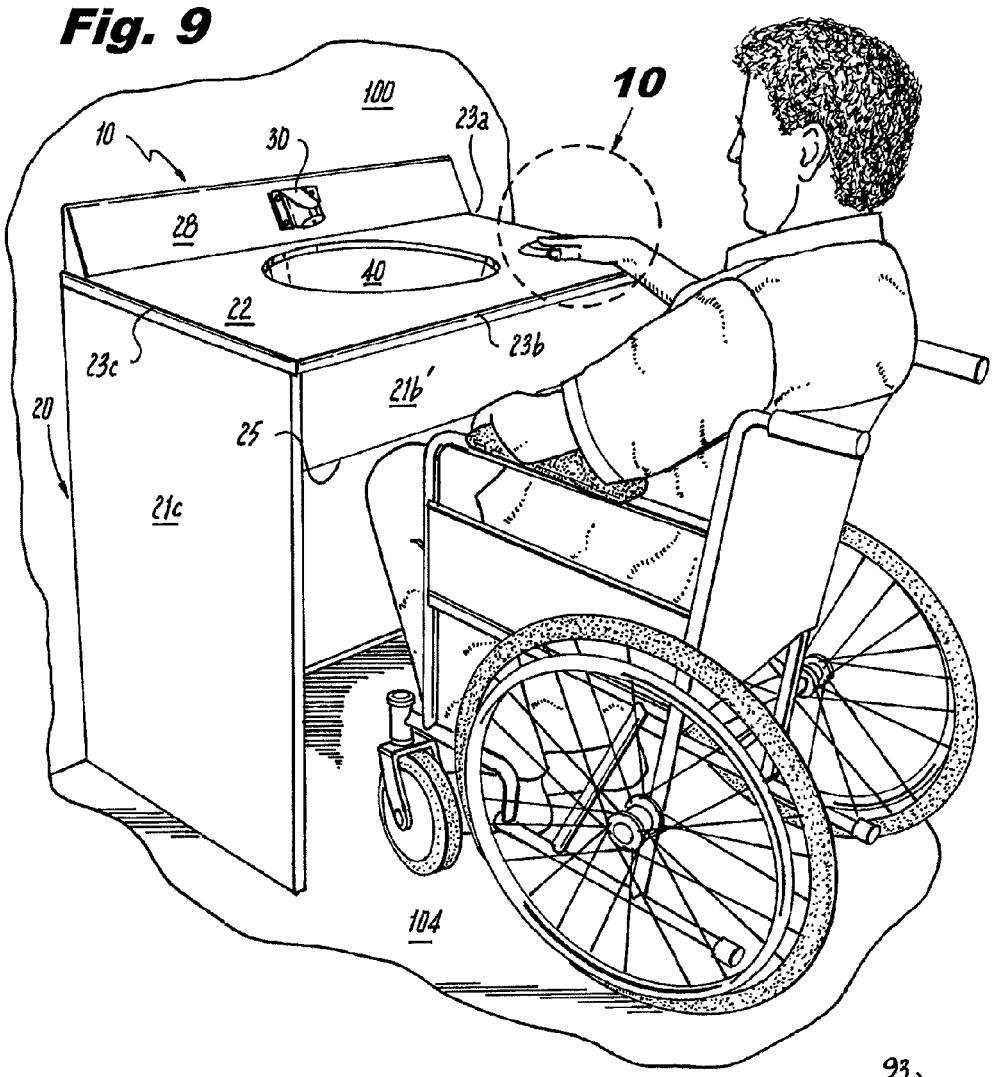
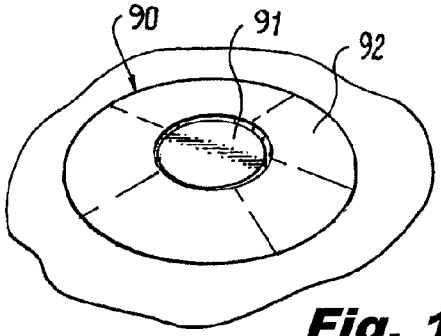
Fig. 10
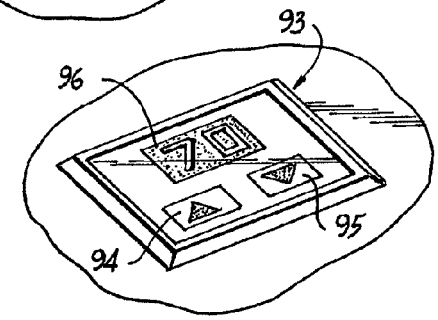
Fig. 11

LIGATURE-RESISTANT LAVATORY ASSEMBLY AND ADJUSTABLE FAUCET AND VALVE

BACKGROUND OF THE INVENTION

1. Field of the Invention

The invention is in the field of lavatory sinks and vanities. More particularly, the present invention is directed to a ligature-resistant lavatory assembly and ligature-resistant thermally adjustable faucet and valve, which are suitable for use in institutions, such as, for example, behavioral health and psychiatric facilities, or prisons, due to their ligature-resistant structures.

2. Brief Description of the Prior Art

It is known in the art to provide lavatory sinks and vanities. However, in particular institutional facilities, such as, behavioral health facilities, psychiatric facilities, or prisons, it is desirable to install ligature-resistant faucets and lavatories, which are resistant to a patient or inmate from affixing a tie to the same to hang themselves or cause other self-harm using the devices. Therefore, it is desirable to provide a faucet and lavatory assembly having a ligature-resistant structure, i.e., having a structure that is resistant to the risks of suicide and self-harm because a tie which is attempted to be affixed to it, would slip off the faucet or vanity.

It is known to provide ligature-resistant lavatory faucet assemblies, however, in certain faucet assemblies, the faucet assemblies are not ligature-resistant in all directions and, therefore, it is still possible for a patient to hang himself or herself. Accordingly, it is advantageous to provide a lavatory assembly which is ligature-resistant in all directions.

There are also numerous other disadvantages to certain of the ligature-resistant faucet assemblies currently available. Particularly, it is difficult to enclose a wall hung lavatory such that the patient/inmate does not have access to the plumbing piping which also serves as an anchor or support for a tie. Therefore, it is desirable to provide a ligature-resistant lavatory assembly which restricts access to the plumbing pipework by the patient/inmate but allows for access by authorized persons, such as maintenance personnel.

Moreover, it is not possible in certain ligature-resistant lavatory assemblies for the patient/inmate to control the temperature of the water dispensed from the faucet and, therefore, it is desirable to provide ligature-resistant means for the user to control the temperature of the water dispensed from the faucet.

In addition, the structure of certain lavatory assemblies may allow for a tie to be secured thereon which can be used to inflict self-harm by the patient/inmate, such as the overflow of a sink, certain drain structures, faucet spouts, and handles. Moreover, it is also possible for a patient/inmate to break a china lavatory and, thereby, create tie support points as well as pieces of china having sharp edges, which can then be used as weapons. Therefore, there is a need for a ligature-resistant vanity and faucet, which resolves these deficiencies in the prior art.

However, so far as is known, none of the prior art devices resolve all of these problems in a simple, effective and yet highly advantageous manner as does the present invention discussed herein.

SUMMARY OF THE INVENTION

It is therefore an object of the invention to provide a novel ligature-resistant lavatory assembly and ligature-resistant adjustable faucet and valve.

It is another object of the invention to provide a ligature-resistant lavatory assembly which encloses the plumbing pipework and restricts access thereto.

It is also an object of the invention to provide a ligature-resistant lavatory assembly which resists a tie from being secured to the housing unit.

It is a further object of the invention to provide a ligature-resistant, adjustable faucet to allow the user to control the temperature of water dispensed from the faucet.

It is yet another object of the invention to provide a ligature-resistant, adjustable faucet which resists a tie being secured thereto.

It is therefore also an object of the invention to provide a ligature-resistant lavatory assembly and adjustable faucet and valve which has a relatively simple construction.

Certain of the foregoing and related objects are readily attained according to the present invention by the provision of a ligature-resistant, manually-operated faucet assembly for controlling the temperature of water dispensed from a faucet, comprising a fixable seating element having a planar, generally circular-shaped base having an outer peripheral edge and a ring-shaped, upstanding raised rim joined to said outer peripheral edge of said base, said raised rim having an upwardly extending and radially inwardly tapered outer sidewall and an upwardly extending inner sidewall, said inner sidewall and said base cooperatively defining a generally disk-shaped recessed seat; and a generally disk-shaped control knob at least partially rotatably received within said recessed seat of said seating element for adjusting the temperature of water dispensed from the faucet.

Preferably, said control knob has a central hub, an outer peripheral edge, and a plurality of spaced-apart, radially-extending spokes extending from said central hub to said outer peripheral edge of said control knob, which define therebetween finger wells for facilitating manual rotation of said control knob. In a preferred embodiment, said central hub is raised and said plurality of radially-extending spokes slope downwardly from said central hub to said outer peripheral edge of said control knob.

Desirably, the assembly further comprises a mixing valve having an upstanding, rotatable control shaft connected to said control knob, whereby rotation of said control knob rotates said control shaft which, controls said mixing valve and, in turn, adjusts the temperature of water dispensed from the faucet.

Certain of the foregoing and related objects are readily attained according to the present invention also by the provision of a ligature-resistant lavatory assembly adapted to be secured against a wall having ingoing hot and cold water supply lines and an outgoing drain line, comprising an at least partially enclosed housing securable against the wall, said housing having a generally horizontal top surface defining an opening therein and a plurality of sidewalls, wherein when said housing is secured to the wall, said top surface and at least a portion of said sidewalls, cooperatively define with the wall a closed interior space to restrict access thereto; a backsplash extending upwardly from said top surface of said housing and disposed against the wall, said backsplash having a downwardly-sloped configuration to resist a tie from being secured thereon; a faucet affixed to said backsplash, connectable with the hot and cold water supply lines, and having an outlet to dispense water, said faucet having a downwardly-sloped configuration to resist a tie from being secured thereto; means for connecting the hot and cold water supply lines to said faucet, which are enclosed within said interior space of said housing; faucet control means for controlling the dispensing of water from said faucet, said faucet control means being mounted on said housing; a sink basin to receive water dispensed from said faucet, said sink basin being recessed within said opening defined in said top surface of said housing and received within said interior space of said housing; a drain located in said sink basin; and means for connecting said drain to the drain line, which are enclosed within said interior space of said housing.

Advantageously, the lavatory assembly further comprises a mixing valve enclosed within said interior space of said housing, having a first inlet connectable to the hot water supply line, a second inlet connectable to the cold water supply line, and an outlet connected to said faucet, said mixing valve being connected to and operable by said faucet control means to adjust the temperature of water dispensed from said faucet.

In a preferred embodiment, said faucet control means is a ligature-resistant, manually-operated faucet assembly for controlling the temperature of water dispensed from said faucet, which is attached to said mixing valve, wherein rotation of said faucet assembly controls said mixing valve and, in turn, adjusts the temperature of water dispensed from said faucet.

In a further preferred embodiment, said manually-operated faucet assembly has a fixed seating element having a planar, generally circular-shaped base having an outer peripheral edge and a ring-shaped, upstanding raised rim joined to said outer peripheral edge of said base, said raised rim having an upwardly extending and radially inwardly tapered outer sidewall and an upwardly extending inner sidewall, said inner sidewall and said base cooperatively defining a generally disk-shaped recessed seat, said base connected to said housing; and a generally disk-shaped control knob at least partially rotatably received within said recessed seat of said seating element; wherein said mixing valve has an upstanding, rotatable control shaft connected to said control knob, whereby rotation of said control knob rotates said control shaft which, controls said mixing valve and, in turn, adjusts the temperature of water dispensed from said faucet.

Desirably, said control knob has a central hub, an outer peripheral edge, and a plurality of spaced-apart, radially-extending spokes extending from said central hub to said outer peripheral edge of said control knob, which define therebetween finger wells for facilitating manual rotation of said control knob. It is further preferred that said central hub is raised and said plurality of radially-extending spokes slope downwardly from said central hub to said outer peripheral edge of said control knob.

Most desirably, said drain has grid drain having a plurality of spaced-apart holes therein which are approximately 3/32" in diameter. Furthermore, it is preferable that said opening defined in said top surface of said housing has a peripheral edge, said peripheral edge of said opening being disposed flush against said sink basin.

In yet another preferred embodiment, the lavatory assembly, further comprises an air-supply vent disposed within said interior space of said housing and connected to said means for connecting said drain to the drain line, to facilitate drainage of water from said sink basin. Preferably, the push button faucet control means includes a push button surrounded by a downwardly-sloping rim having an upwardly extending and radially inwardly tapered outer sidewall and an upwardly extending vertical inner sidewall.

In an alternate embodiment, said faucet control means is a push-button. In another alternate embodiment, said faucet control means is a touch-screen panel to adjust the temperature of water dispensed from said faucet.

Advantageously, at least one of said sidewalls has at least a portion which is removable and is removably connected to said housing by tamper-resistant fasteners. It is also desirable that the ligature-resistant lavatory assembly further comprises means for securing said housing against the wall.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

FIG. 6 is an enlarged perspective view of the faucet and ligature-resistant faucet control assembly;

FIG. 7 is an exploded view of the faucet pulled out of the housing;

FIG. 8 is a side sectional elevational view taken along line 8-8 of FIG. 6, showing the downwardly-sloping backsplash and faucet;

FIG. 9 is an alternate wheelchair accessible ligature-resistant lavatory assembly;

FIG. 10 is an enlarged view of a ligature-resistant push-button faucet control; and FIG. 11 is an enlarged view of a touch-screen faucet control panel.

DETAILED DESCRIPTION OF THE PREFERRED EMBODIMENTS

Figure 1:
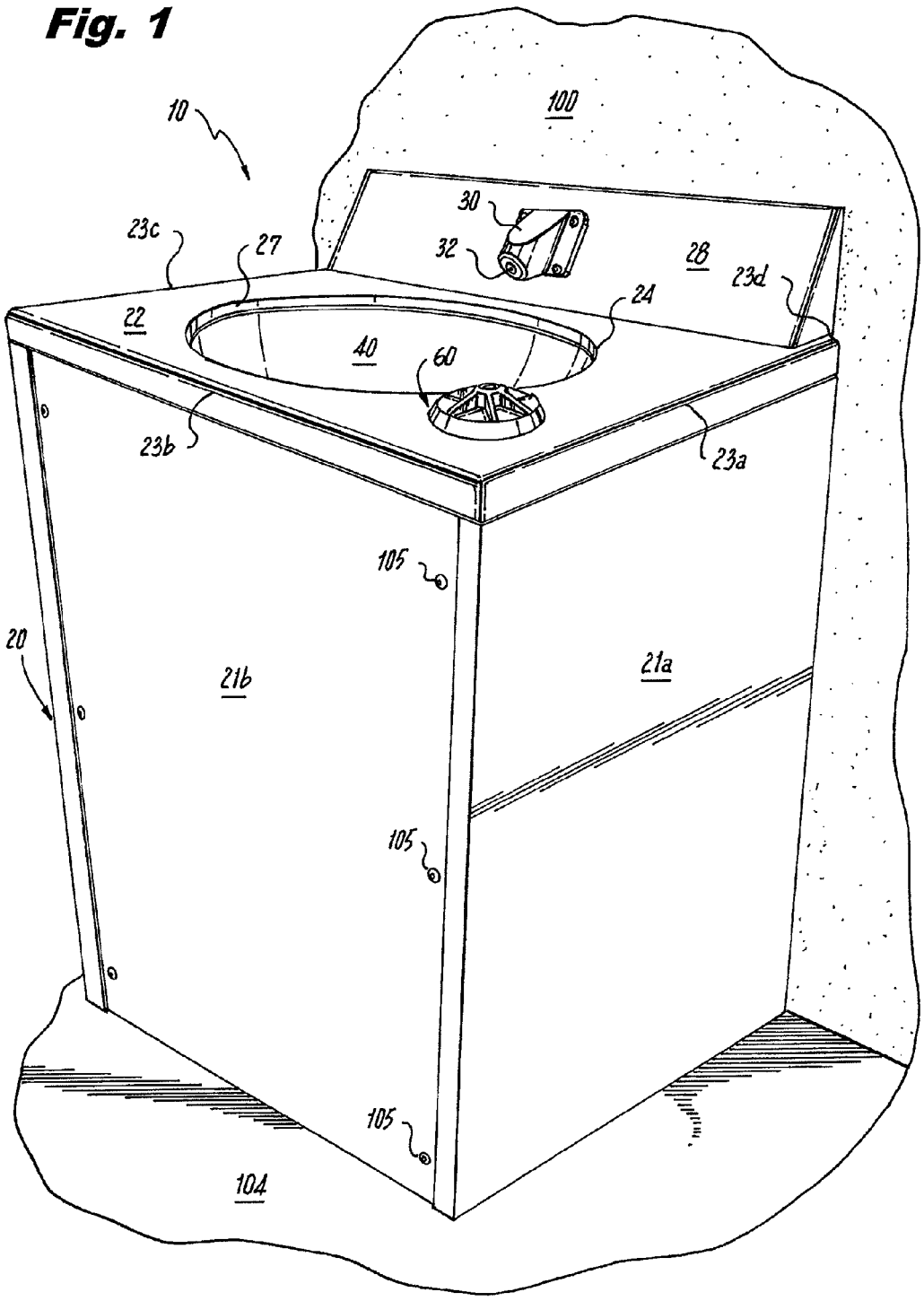
FIG. 1 is a perspective view of a ligature-resistant lavatory assembly according to the present invention, installed against a wall.

Turning now in detail to the drawings, and in particular, FIG. 1, therein illustrated is a novel, ligature-resistant lavatory assembly, generally designated by reference numeral 10, incorporating a ligature-resistant faucet and valve assembly, generally designated by reference numeral 60, embodying the present invention.

As seen in FIG. 1, ligature-resistant lavatory assembly 10 includes a vanity or housing 20 which is mounted against and affixed to a wall 100 and which is particularly suitable for behavioral health facilities, psychiatric facilities, or prisons. As seen best in FIGS. 2 and 4, wall 100 includes an ingoing hot water supply line 101, an ingoing cold water supply line 102, and an outgoing waste or drain line 103. Cabinet or housing 20 can also be secured to floor 104, to prevent a patient/inmate from kicking in or otherwise removing housing 20.

As seen best in FIG. 1, housing 20 preferably has three vertical sidewalls 21*a*, 21*b*, and 21*c* (not shown) and a horizontally disposed top surface 22. Top surface 22 has a generally-rectangular shape having four side edges, 23*a*, 23*b*, 23*c*, and 23*d*. Side edge 23*d* is disposed against wall 100. In a first embodiment, as seen in FIG. 1, sidewalls 21*a*, 21*b*, and 21*c* of housing 20 extend vertically downwardly, from side edges 23*a*, 23*b*, and 23*c* of top surface 22, respectively, to floor 104.

In the first embodiment illustrated in FIG. 1, when housing 20 is secured to wall 100, top surface 22 and sidewalls 21*a*, 21*b*, and 21*c* cooperatively define with wall 100, a closed interior space which has restricted access to prevent a patient/inmate from accessing the same. The interior space defined within housing 20 encloses the plumbing pipework including hot water supply line 101, cold water supply line 102, and drain line 103. As also seen in FIG. 1, sidewall 21*b* is removably secured to housing 20 through tamper-resistant fasteners 105, such as the tamper-resistant fasteners made by Tamperproof Screw Co., Inc. of Hicksville, N.Y. Tamper-resistant fasteners 105 are resistant to removal by a patient/inmate, however, allow for removal by authorized persons, such as, for example, maintenance personnel, through use of a tool specifically adapted to remove tamper-resistant fasteners and are to be specified by the end user depending on the nature of the environment. Preferably, top surface 22 of housing 20 is made of a ½" solid surface material and sidewalls 21*a-c* are made of a waterproof ¾" PVC material such as that made by Certainteed Corp. of Valley Forge, Pa. However, other suitable materials can be utilized.

In an alternate embodiment of housing 20, seen in FIG. 9, housing 20 is wheelchair accessible. In the alternate wheelchair accessible embodiment seen in FIG. 9, sidewalls 21*a* and 21*c* are similar to that in the first embodiment shown in FIG. 1, and extend vertically downwardly from side edges 23*a* and 23*c* of top surface 22, respectively, to floor 104. However, sidewall 21*b*', extends downwardly only partially from side edge 23*b* to floor 104 to accommodate a user in a wheelchair. A horizontally disposed lower wall 25 which is parallel to top surface 22 extends from the bottom edge of sidewall 21*b* to wall 100. In a further ADA compliant wheelchair version of housing 20, lower wall 25 extends only partially towards wall 100, preferably 8" from sidewall, and an angled back wall (not shown) slopes downwardly from the rear edge of lower wall 25 towards wall 100 and floor 104. A second lower wall (not shown) is disposed parallel to lower wall 25 and extends from the bottom edge of the angled back wall to wall 100 (not shown). When housing 20 is mounted to wall 100, sidewall 21*b*' forms in conjunction with upper portions of sidewalls 21*a* and 21*c* and wall 100, a closed interior space to enclose the plumbing pipework, as in the embodiment illustrated in FIG. 1. However, other suitable housing or cabinet arrangements can be utilized to meet the ADA requirements.

As also illustrated in FIG. 1, housing 20 includes a backsplash 28 which extends upwardly from side edge 23*d* of top surface 22 and is disposed against wall 100. As seen best in FIG. 8, backsplash 28 has a downwardly-sloped configuration, so as to resist a tie from being secured thereto. It is preferable that top edge 29 of backsplash 28 or any other gaps between housing 20 and wall 100 are filled with pick-resistant caulk (not shown), so that housing 20 is sealed to wall 100 so as to resist a tie from being placed behind it. The preferable pick-resistant caulk is, for example, PECORA DYNAPOXY EP-1200 manufactured by Pecora Corporation of Harleysville, Pa., however, other sealants suitable for use in institutions can be utilized.

In addition, as seen in FIGS. 1 and 6, ligature-resistant lavatory assembly 10 also includes a water-dispensing faucet 30, preferably affixed to backsplash 28 through use of tamper resistant fasteners 105, as seen in FIG. 7. Faucet 30 is connectable via hose or tubing 11, preferably a stainless steel flexible braided hose or copper tubing, to hot water line 101 and cold water line 102 via mixing valve 50 (See, FIGS. 2, 7 and 8). Faucet 30 has an outlet 32 to dispense water therefrom. The plumbing pipework to connect faucet 30 with hose 11 and hot and cold water lines 101,102, respectively, are enclosed within the interior space of housing 20, to restrict access thereto, and would be well known to one having ordinary skill in the art. As seen best in FIG. 8, faucet 30 has a downwardly-sloped configuration, so as to resist a tie from being secured thereto. However, other suitable ligature-resistant faucet configurations may be utilized.

Figure 5:
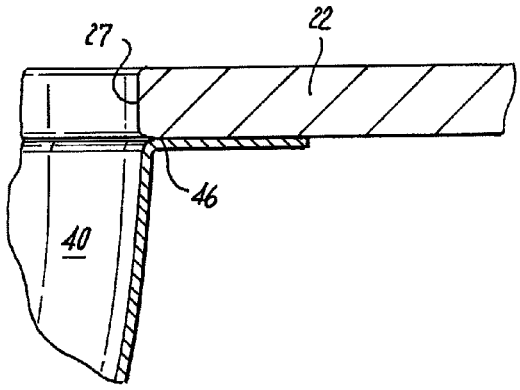
FIG. 5 is a broken sectional view taken along line 5-5 of FIG. 4 showing the top edge of the sink and the top surface of the housing.

Additionally, as seen in FIG. 1, top surface 22 of housing 20 also defines an opening 24 therein having a peripheral edge 27. Ligature-resistant lavatory assembly 10 includes a sink basin 40 to receive water dispensed from faucet 30. As seen in FIGS. 1 and 5, sink 40 is recessed within opening 24 in top surface 22 and is received within the enclosed interior space of housing 20. As shown best in FIG. 5, it is advantageous that top edge 46 of sink 40 is disposed flush against peripheral edge 27 of opening 24, so that there is no lip between sink 40 and top surface 22, to prevent an object from being inserted therein. Preferably, sink basin 40 is made of stainless steel and does not include an overflow, so that an object cannot be placed therein.

Figure 4:
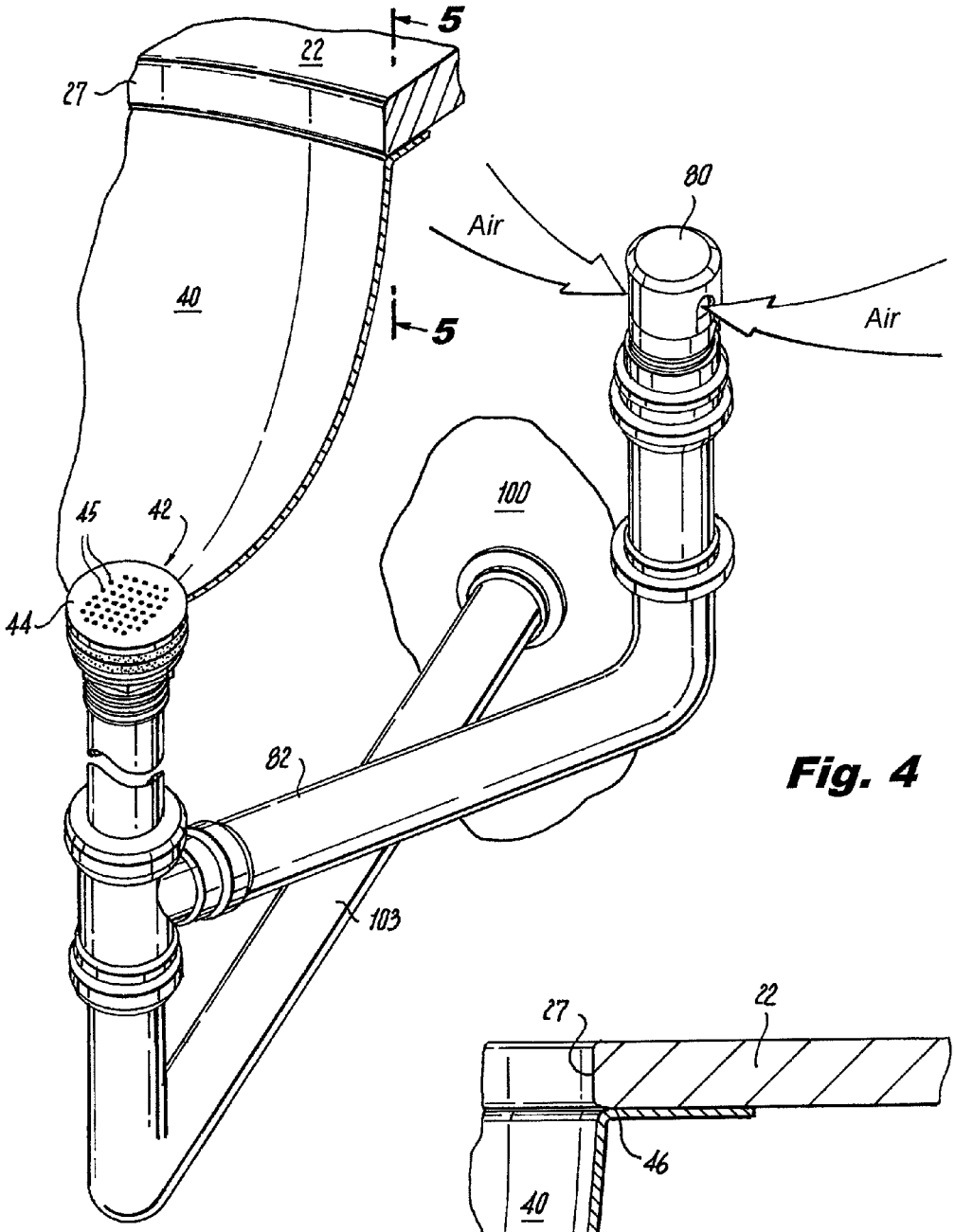
FIG. 4 is an enlarged broken sectional view of the sink basin and top surface of the housing also showing, the drain, the drain line and air-feeder assembly.

As seen best in FIG. 4, sink 40 also includes a drain 42 connectable to outgoing drain line 103 to allow for water to exit sink 40. The plumbing pipework to connect drain 42 with outgoing drain line 103 are enclosed within the interior space of housing 20, to restrict access thereto, and would be well known to one having ordinary skill in the art. Drain 42 preferably includes a grid drain 44 which has a plurality of spaced-apart holes 45 preferably 3/32" in diameter, to resist an object from being placed therein. Grid drain 44 is preferably nickle plated cast bronze.

To improve drainage of water out of sink 40 via drain 42, a conventional automatic plumbing air-supply vent 80 is connected to drain 42 via pipe 82, to allow air to enter drain 42. Preferably, air-supply vent 80 is CAST-VENT manufactured by Rich Hwang Co. of Taiwan, R.O.C. However, other suitable plumbing air-supply vents can be utilized. Air supply vent 80 and pipe 82 are enclosed within housing 20, to restrict access thereto. The connection of air supply vent 80 and pipe 82 to drain 42 would be well known to one having ordinary skill in the art.

Figure 2:
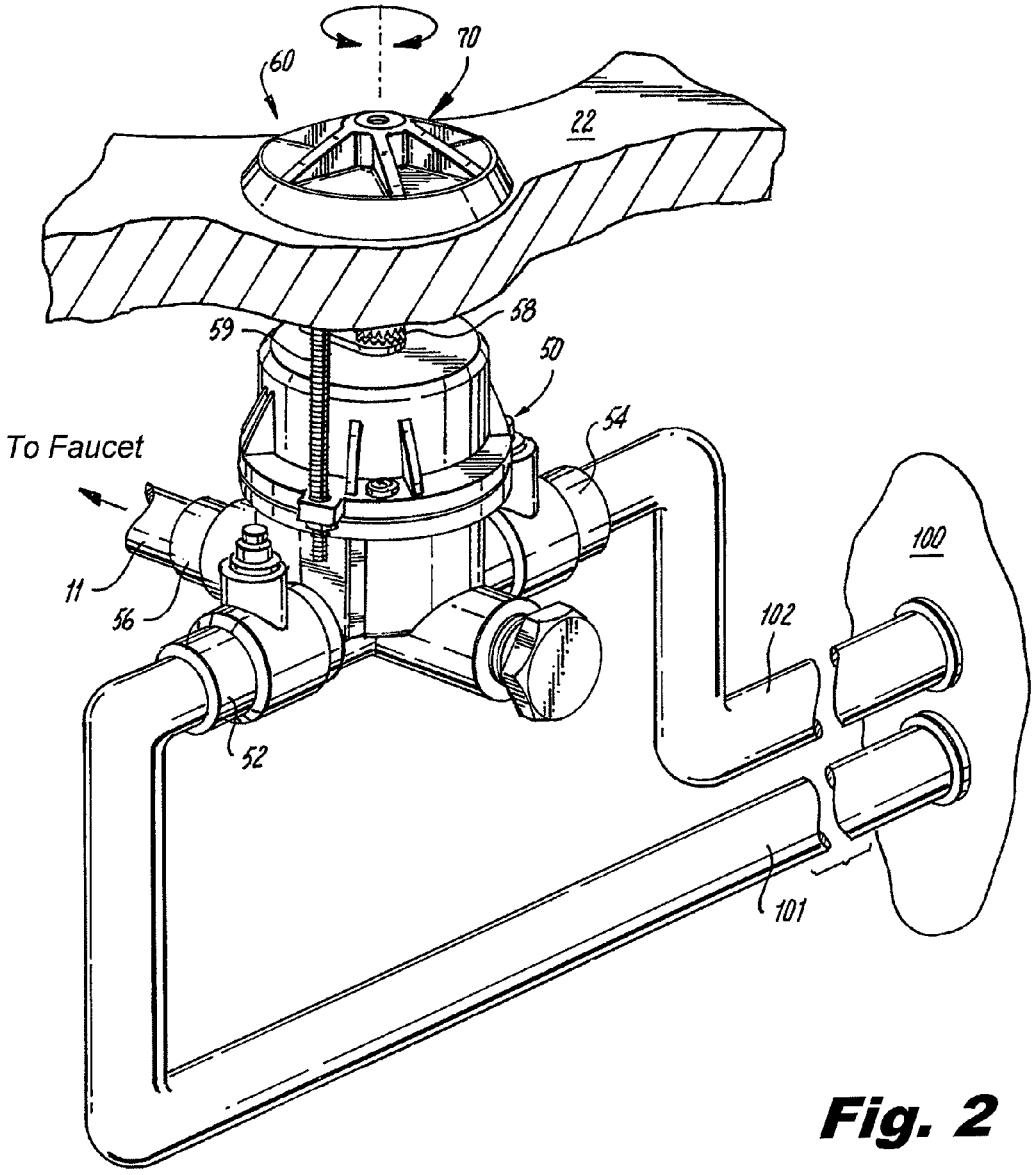
FIG. 2 is an enlarged perspective view showing the ligature-resistant faucet control assembly and mixing valve.
Figure 3:
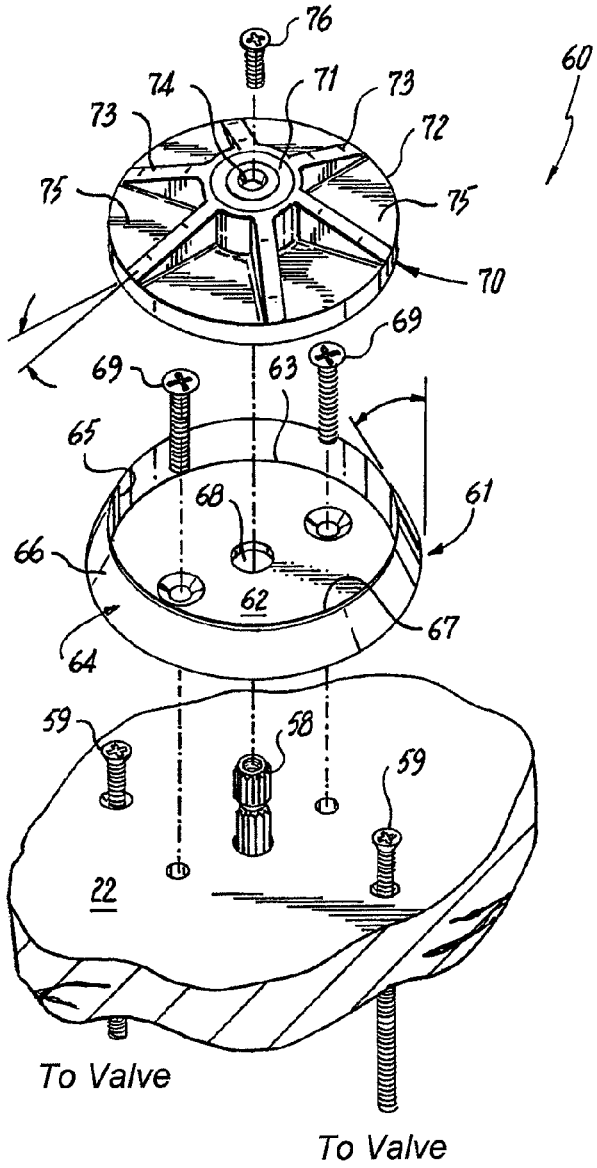
FIG. 3 is an exploded perspective view of the components of the ligature-resistant faucet control assembly, shown in FIG. 2.

In addition, as seen in best in FIG. 2, the ligature-resistant lavatory assembly 10 also includes a conventional water mixing valve 50 enclosed within the interior space of housing 20, to restrict access thereto. Mixing valve 50 may be one of a number of commercially available water mixing valves preferably having a non-rising shaft which is easy to turn, although there may be other suitable mixing values. The preferred mixing valve is a pressure balanced mixing valve with spring check stops and high temperature limit or that of U.S. Pat. No. 3,559,684 granted to Speakman Co. of Wilmington, Del., the contents of which are hereby incorporated by reference. As seen in FIGS. 2 and 3, mixing valve 50 is connected to housing 20 by two screws 59 which extend through top surface 22 and into mixing valve 50.

As seen in FIG. 2, mixing valve 50 includes a first inlet 52 connectable to the hot water line 101 and a second inlet 54 connectable to the cold water line 102. Mixing valve 50 also includes an outlet 56 which is connected to faucet 30 by hose 11. The connection of hot water line 101, cold water line 102, and faucet 30 via hose 11, to mixing valve 50 would be well known to one having ordinary skill in the art. Mixing valve 50 is adjustable to vary the amount of incoming water from hot water line 101 and cold water line 102 which are mixed together and, subsequently dispensed from outlet 56 of mixing valve 50, to in turn, adjust the temperature of water exiting faucet 30.

As also seen in FIG. 1, ligature-resistant lavatory assembly 10 also includes a manually-operated, rotatable ligature-resistant faucet control assembly, generally designated by reference numeral 60, which controls mixing valve 50. Ligature-resistant faucet control assembly 60 is mounted to top surface 22 of housing 20, however, its precise location can vary. The shape of ligature-resistant faucet control assembly 60 is such that it resists a tie from being affixed thereto. As seen best in FIGS. 2 and 3, ligature-resistant faucet control assembly 60 is connected to mixing valve 50, to allow the user to turn the faucet control 60 in order to adjust the temperature of water dispensed from faucet 30.

Particularly, turning now to FIG. 3, ligature-resistant faucet control assembly 60, includes a seating element 61, which is affixed to top surface 22 of housing 20 by screws 69. Preferably screws 69 are counter-sunk. Seating element 61 has a planar, generally circular-shaped base 62 having an outer peripheral edge 63. Seating element 61 also has a ring-shaped, upstanding raised rim 64 which is joined to peripheral edge 63 of base 62. Rim 64 has an upwardly extending and radially inwardly tapered outer sidewall 66 and an upwardly extending inner sidewall 65. The inner sidewall 65 and base 62 cooperatively define therebetween a generally disk-shaped recessed seat 67. Preferably, seating element 61 is made of chrome plated brass. However, other suitable materials could be utilized.

As also seen in FIG. 3, ligature-resistant faucet control assembly 60 also includes a generally disk-shaped control knob 70 which is at least partially rotatably received in recessed seat 67 of seating element 61. Rotation of control knob 70 controls mixing valve 50 and, in turn, adjusts the temperature of water dispensed from faucet 30. Preferably, control knob 70 is made of chrome-plated bronze material. However, other suitable materials can be utilized.

More particularly, control knob 70 has a raised central hub 71 and an outer peripheral edge 72. A plurality of spaced-apart, downwardly-sloped, radially-extending spokes 73 extend from raised central hub 71 to peripheral edge 72. Finger wells 75 are defined between spokes 73, to allow a user to grasp control knob 70 and therefore, facilitates manual rotation, to dial the desired temperature of water dispensed from faucet 30.

As seen in FIGS. 2 and 3, mixing valve 50 has an upstanding, rotatable control shaft 58 which extends through aperture 68 formed in said base 62 of seating element 61. Control shaft 58 is connected to control knob 70 via screw 76 in a manner to allow control knob 70 to be rotatable. Screw 76 is tamper-resistant and preferably counter-sunk into control knob 70. Rotation of control knob 70, in turn, rotates control shaft 58 which controls mixing valve 50 by adjusting the amount of water inlet from hot water line 101 and cold water line 102 which are mixed together and subsequently dispensed from outlet 56 of mixing valve 50 into hose 11 to, in turn, adjust the temperature of water dispensed from faucet 30, as seen in FIG. 6.

As an alternative to the ligature-resistant faucet control 60, a push button control assembly 90 as seen in FIG. 10, is connected to a conventional thermostatic mixing valve (not shown) and can be utilized to control water dispensed from faucet 30. As shown in FIG. 10, push button control assembly 90 includes a depressable push button 91 and surrounding circular-shaped downwardly sloping rim 92. Rim 92 has an upwardly extending and radially inwardly tapered outer sidewall, to resist a tie from being secured thereto and an upwardly extending vertical inner sidewall that is flush against push button 91 so that an object cannot be placed therebetween. Particularly, push button 90 is movable between a first, off position in which it is disposed flush with a top edge of rim 92 and a second depressed, on position in which push button 91 is pressed down so that it is recessed beneath the top edge of rim 92 to actuate the water to be dispensed from faucet 30. The connection of the push button control assembly 90 to a thermostatic mixing valve would be well known to one having ordinary skill in the art.

In another alternative embodiment, a touch screen panel 93 connected to mixing valve 50 can be utilized to control the temperature of water dispensed from faucet 30. The necessary electronic circuitry to connect touch screen panel 93 to mixing valve 50 would be well known to one having ordinary skill in the art. Touch screen panel 93 includes a touch sensitive panel or "button" 94 to increase the temperature of the water, a touch sensitive panel or a "button" 95 to decrease the temperature of the water and a screen display 96 to show the temperature of the water.

While particular embodiments of the invention have been described, it is not intended that the invention be limited thereto, as it is intended that the invention be as broad in scope as the prior art will allow and that the specification be read likewise. It will therefore be appreciated by those skilled in the art that other modifications could be made thereto without departing from the spirit and scope of the invention. Particularly, the shape of the faucet can be modified as long as it is ligature-resistant. Furthermore, the housing can have a modified shape and size so long as it restricts access to the interior compartment which enclosed the plumbing pipework and is ligature-resistant. Although it is preferred that the housing rest on the floor, there are applications whereby the housing can be exclusively wall mounted into a recessed alcove.

What is claimed is:

1. A lavatory assembly which is ligature-resistant in all directions and adapted to be secured against a wall having ingoing hot and cold water supply lines and an outgoing drain line, comprising:

an at least partially enclosed housing securable against the wall, said housing having a generally horizontal top surface defining an opening therein and a plurality of sidewalls, wherein when said housing is secured to the wall, said top surface and at least a portion of said sidewalls, cooperatively define with the wall a closed interior space to restrict access thereto;

a backsplash which is ligature-resistant in all directions, extending upwardly from said top surface of said housing and disposed against the wall, said backsplash having at least a portion which is downwardly-sloped in a direction away from the wall, to resist a tie from being secured thereon in all directions;

a faucet which is ligature-resistant in all directions, affixed to said backsplash, connectable with the hot and cold water supply lines, and having an outlet to dispense water, said faucet comprising a generally U-shaped planar upper surface having an upper edge which is disposed generally adjacent to said backsplash and a lower edge which is spaced outwardly from said backsplash, and wherein said upper surface extends outwardly and slopes downwardly from said backsplash in a direction away from the wall, said upper surface having a generally U-shaped edge portion extending outwardly from said upper edge, to resist a tie from being secured to said faucet in all directions;

means for connecting the hot and cold water supply lines to said faucet, which are enclosed within said interior space of said housing;

faucet control means which are ligature-resistant in all directions, for controlling the dispensing of water from said faucet, said faucet control means being mounted on said horizontal top surface of said housing and comprising a manually-operated faucet assembly which is ligature-resistant in all directions, comprising a fixed seating element having a planar, generally circular-shaped base having an outer peripheral edge and a ring-shaped, upstanding raised rim joined to said outer peripheral edge of said base, said raised rim having an upwardly extending and radially inwardly tapered outer sidewall and an upwardly extending inner sidewall, said inner sidewall and said base cooperatively defining a generally disk-shaped recessed seat, said base connected to said housing; and a generally disk-shaped control knob at least partially rotatably received within said recessed seat of said seating element, wherein said control knob comprises a generally circular-shaped base having a generally planar upper surface and an outer peripheral edge, said control knob further comprises a generally cylindrically-shaped raised central hub disposed inwardly from said outer peripheral edge of said base and extending upwardly from said planar upper surface of said base, and a plurality of spaced-apart, generally triangular-shaped spokes extending radially outwardly and sloping downwardly from said raised central hub to said outer peripheral edge of said control knob, said spokes and said planar upper surface of said base cooperatively defining finger wells therebetween for facilitating manual rotation of said control knob;

a sink basin to receive water dispensed from said faucet, said sink basin being recessed within said opening defined in said top surface of said housing and received within said interior space of said housing;

a drain located in said sink basin; and means for connecting said drain to the drain line, which are enclosed within said interior space of said housing.

2. The ligature-resistant lavatory assembly according to claim 1, further comprising:

a mixing valve enclosed within said interior space of said housing, having a first inlet connectable to the hot water supply line, a second inlet connectable to the cold water supply line, and an outlet connected to said faucet, said mixing valve being connected to and operable by said faucet control means to adjust the temperature of water dispensed from said faucet.

3. The ligature-resistant lavatory assembly according to claim 2, wherein:

said faucet control means is a ligature-resistant, manually-operated faucet assembly for controlling the temperature of water dispensed from said faucet, which is attached to said mixing valve, wherein rotation of said faucet assembly controls said mixing valve and, in turn, adjusts the temperature of water dispensed from said faucet.

4. The ligature-resistant lavatory assembly according to claim 1, wherein:

said drain has grid drain having a plurality of spaced-apart holes therein which are approximately 3/32" in diameter.

5. The ligature-resistant lavatory assembly according to claim 1, wherein:

said opening defined in said top surface of said housing has a peripheral edge, said peripheral edge of said opening being disposed flush against said sink basin.

6. The ligature-resistant lavatory assembly according to claim 1, further comprising:

an air-supply vent disposed within said interior space of said housing and connected to said means for connecting said drain to the drain line, to facilitate drainage of water from said sink basin.

7. The ligature-resistant lavatory assembly according to claim 1, wherein:

at least one of said sidewalls has at least a portion which is removable and is removably connected to said housing by tamper-resistant fasteners.

8. The ligature-resistant lavatory assembly according to claim 3, wherein:

said mixing valve has an upstanding, rotatable control shaft connected to said control knob, whereby rotation of said control knob rotates said control shaft which, controls said mixing valve and, in turn, adjusts the temperature of water dispensed from said faucet.

9. A lavatory assembly which is ligature-resistant in all directions and adapted to be secured against a wall having ingoing hot and cold water supply lines and an outgoing drain line, comprising:

an at least partially enclosed housing securable against the wall, said housing having a generally horizontal top surface defining an opening therein and a plurality of sidewalls, wherein when said housing is secured to the wall, said top surface and at least a portion of said sidewalls, cooperatively define with the wall a closed interior space to restrict access thereto;

a backsplash which is ligature-resistant in all directions, extending upwardly from said top surface of said housing and disposed against the wall, said backsplash having at least a portion which is downwardly-sloped in a direction away from the wall, to resist a tie from being secured thereon in all directions;

a faucet which is ligature-resistant in all directions, affixed to said backsplash, connectable with the hot and cold water supply lines, and having an outlet to dispense water, said faucet comprising a generally U-shaped planar upper surface having an upper edge which is disposed generally adjacent to said backsplash and a lower edge which is spaced outwardly from said backsplash, and wherein said upper surface extends outwardly and slopes downwardly from said backsplash in a direction away from the wall, said upper surface having a generally U-shaped edge portion extending outwardly from said upper edge, to resist a tie from being secured to said faucet in all directions;

means for connecting the hot and cold water supply lines to said faucet, which are enclosed within said interior space of said housing;

faucet control means which are ligature-resistant in all directions, for controlling the dispensing of water from said faucet, said faucet control means being mounted on said horizontal top surface of said housing;

a sink basin to receive water dispensed from said faucet, said sink basin being recessed within said opening defined in said top surface of said housing and received within said interior space of said housing;

a drain located in said sink basin; and means for connecting said drain to the drain line, which are enclosed within said interior space of said housing.

10. The ligature-resistant lavatory assembly according to claim 9, wherein:

said faucet control means is a ligature-resistant manually-operated faucet assembly comprising a fixed seating element having a planar, generally circular-shaped base having an outer peripheral edge and a ring-shaped, upstanding raised rim joined to said outer peripheral edge of said base, said raised rim having an upwardly extending and radially inwardly tapered outer sidewall and an upwardly extending inner sidewall, said inner sidewall and said base cooperatively defining a generally disk-shaped recessed seat, said base connected to said housing; and a generally disk-shaped control knob at least partially rotatably received within said recessed seat of said seating element, wherein said control knob comprises a generally circular-shaped base having a generally planar upper surface and an outer peripheral edge, said control knob further comprises a generally cylindrically-shaped raised central hub disposed inwardly from said outer peripheral edge of said base and extending upwardly from said planar upper surface of said base, and a plurality of spaced-apart, generally triangular-shaped spokes extending radially outwardly and sloping downwardly from said raised central hub to said outer peripheral edge of said control knob, said spokes and said planar upper surface of said base cooperatively defining finger wells therebetween for facilitating manual rotation of said control knob.

11. The ligature-resistant lavatory assembly according to claim 1, wherein:

at least a portion of said backsplash is generally wedge-shaped, having a lower surface overlying said top surface of said housing, a rear surface lying generally flush against the wall, and a front surface having an upper edge and an opposite lower edge, said upper edge being connected to said rear surface and disposed generally adjacent the wall and said lower edge being connected to said lower surface and disposed generally adjacent said top surface of said housing, wherein said lower edge of said front surface is spaced apart from said wall and said front surface is downwardly-sloped from said upper edge to said lower edge in the direction away from the wall, and wherein said backsplash encloses a hose connected to said faucet.

12. The ligature-resistant lavatory assembly according to claim 9, wherein:

at least a portion of said backsplash is generally wedge-shaped, having a lower surface overlying said top surface of said housing, a rear surface lying generally flush against the wall, and a front surface having an upper edge and an opposite lower edge, said upper edge being connected to said rear surface and disposed generally adjacent the wall and said lower edge being connected to said lower surface and disposed generally adjacent said top surface of said housing, wherein said lower edge of said front surface is spaced apart from said wall and said front surface is downwardly-sloped from said upper edge to said lower edge in the direction away from the wall, and wherein said backsplash encloses a hose connected to said faucet.

* * * * *